US006280285B1

(12) United States Patent
Morehouse

(10) Patent No.: US 6,280,285 B1
(45) Date of Patent: Aug. 28, 2001

(54) PROJECTILE LAUNCHING ACTION TOY HAVING MEMBERS CAPABLE OF COORDINATED MOVEMENT

(76) Inventor: Jeffrey C. Morehouse, 325B Betteravia PMB 111, Santa Maria, CA (US) 93454

( * ) Notice: Subject to any disclaimer, the term of this patent is extended or adjusted under 35 U.S.C. 154(b) by 0 days.

(21) Appl. No.: 09/542,658

(22) Filed: Apr. 4, 2000

(51) Int. Cl.[7] ..... A63H 3/20

(52) U.S. Cl. ..... 446/333; 446/333; 446/336; 446/352; 124/4; 124/79

(58) Field of Search ..... 124/4, 6, 79; 446/330, 446/333, 336, 352, 376, 390

(56) References Cited

U.S. PATENT DOCUMENTS

| | | | | |
|---|---|---|---|---|
| 2,249,670 | * | 7/1941 | Sidle | 446/333 |
| 2,506,190 | * | 5/1950 | Barnes | 124/79 |
| 3,503,613 | * | 3/1970 | Caya | 446/336 X |
| 3,911,616 | * | 10/1975 | Pelfrey | 446/333 |
| 4,031,657 | | 6/1977 | Crosman et al. . | |
| 5,046,987 | | 9/1991 | Djordjevic . | |
| 5,449,171 | * | 9/1995 | Makhoulian | 446/336 X |

FOREIGN PATENT DOCUMENTS

| | | | | |
|---|---|---|---|---|
| 86399 | * | 7/1919 | (CH) | 446/376 |

* cited by examiner

*Primary Examiner*—John A. Ricci
(74) *Attorney, Agent, or Firm*—Daniel C. McKown

(57) ABSTRACT

A first member is pivotally connected to a base for rotation about a first axis, and a second member is pivotally connected to the first member for rotation about a second axis. One end of a cable is attached to the base at a point spaced from the first axis, and the other end of the cable is attached to the second member at a point spaced from the second axis. The cable is slidingly engaged by a portion of the first member. As the first member is driven to rotate with respect to the base, the second member is forced to rotate with respect to the first member due to the inextensibility of the cable.

15 Claims, 6 Drawing Sheets

PROJECTILE LAUNCHING ACTION TOY HAVING MEMBERS CAPABLE OF COORDINATED MOVEMENT

BACKGROUND OF THE INVENTION

1. Field of the Invention

The present invention is in the field of toys and more specifically it relates to an action toy which may have the form of a human figure in which movement of a first member about a first joint is coordinated with movement of a second member about a second joint. This coordinated movement permits the toy to simulate more realistically the movements that a person makes when launching various projectiles, such as in shooting a basketball or kicking a football.

2. The Prior Art

Many action toys known in the prior art have stiff limbs that are rotatably mounted to the torso. There are no joints at the elbows, wrists, knees, or ankles. Accordingly, when the limbs are moved, the motion appears to be unrealistic and clumsy. In contrast, in the present invention these members not only move, but are capable of coordinated movements to simulate the actions of athletes.

The animated toy described in U.S. Pat. No. 3,906,661 issued Sep. 23, 1975 to Weiser is typical of the older prior art. That patent shows a doll having a one-piece arm rotatably connected to a shoulder for rotation in a forward direction. The toy doll also has a stiff leg connected at the hip of the figure for rotation in a forward direction.

A more sophisticated action figure is shown in U.S. Pat. No. 4,031,657 issued Jun. 28, 1977 to Crosman et al. Here, the arm of the figure pivots at the shoulder and at the elbow, and the movement of the forearm with respect to the upper arm is determined by a connecting rod which causes the forearm to extend as the upper arm is raised. The use of a connecting rod requires that the axis about which the forearm moves must be parallel to the axis about which the upper arm moves. This limitation is overcome in the present invention, in which the axes of rotation may be skewed. An arm action similar to that of Crosman et al. is said to be produced by the mechanism described in U.S. Pat. No. 5,046,987 issued Sep. 10, 1991 to Djordjevic.

So far as can be determined, no prior art shows a wrist motion for action toys representing human athletic motions. U.S. Pat. No. 4,279,419 of Barnes et al. is typical in its showing of a table top golfing figure in which the upper body is driven by a spring to rotate with respect to the lower body; but the wrists remain rigid.

The motion of the hand about the wrist (or the motion of the lower leg about the knee) is paramount in shooting, throwing or swinging (or kicking). This wrist motion is not constant throughout the athlete's motion while shooting, throwing or swinging. The speed of the wrist rotation is maximum at or near the point of release or the point of impact and is zero minimal in the initial portion of a throw or swing. Such motion has eluded the prior art, but the present invention provides a solution.

The present invention provides a mechanism for simulating with greater reality the coordinated movements used by athletes engaged in various activities.

SUMMARY OF THE INVENTION

It is an object of the present invention to provide a mechanism for coordinating the motion of several articulated members so that the motion of one member is related to the motion of a second member. As used herein, the word "member" includes without limitation various body parts to the extent they are included in the action toy, and also includes various parts of animals or of inanimate objects depending on what the action toy represents.

Another objective is to provide a mechanism that permits the designer to preprogram the velocity and acceleration of the members as the action progresses, so as to simulate more accurately the movements of the human body.

It is a further objective of the present invention to provide a mechanism for coordinating the movement of the members about axes that are skewed.

For the present invention to be applicable, the action toy must have at least three members serially connected, as for example, an upper arm, a forearm, and a hand; or, a lower torso, a thigh, and a calf. In the present invention, the members are usually connected by hinges, notwithstanding that certain joints in the human body are recognized to be capable of a greater variety of motions.

In the present invention a first member is connected to a base for rotation about a first axis, and a second member is connected to the first member for rotation about a second axis. For example, in an action toy representing a football kicker, a thigh is hinged to a stationary torso at a hip, and a calf is hinged to the thigh at a knee. In general, the first axis does not have to be parallel to the second axis.

In accordance with a preferred embodiment of the present invention, one end of a cable is attached to the base at a point spaced from the first axis, and the other end of the cable is attached to the second member at a point spaced from the second axis. In this preferred embodiment the cable is also slidably engaged by a portion of the first member. For example, the cable may pass through an eye, a groove, or a passage on or in the first member. As the first member is rotated by an operator or mechanism with respect to the base, the second member is forced to rotate with respect to the first member due to the inextensibility of the cable. It has been found that the mechanism of this embodiment gives the designer considerable flexibility in achieving realistic movements.

The novel features which are believed to be characteristic of the invention, both as to organization and method of operation, together with further objects and advantages thereof, will be better understood from the following description considered in connection with the accompanying drawings in which several embodiments of the invention are illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 13:
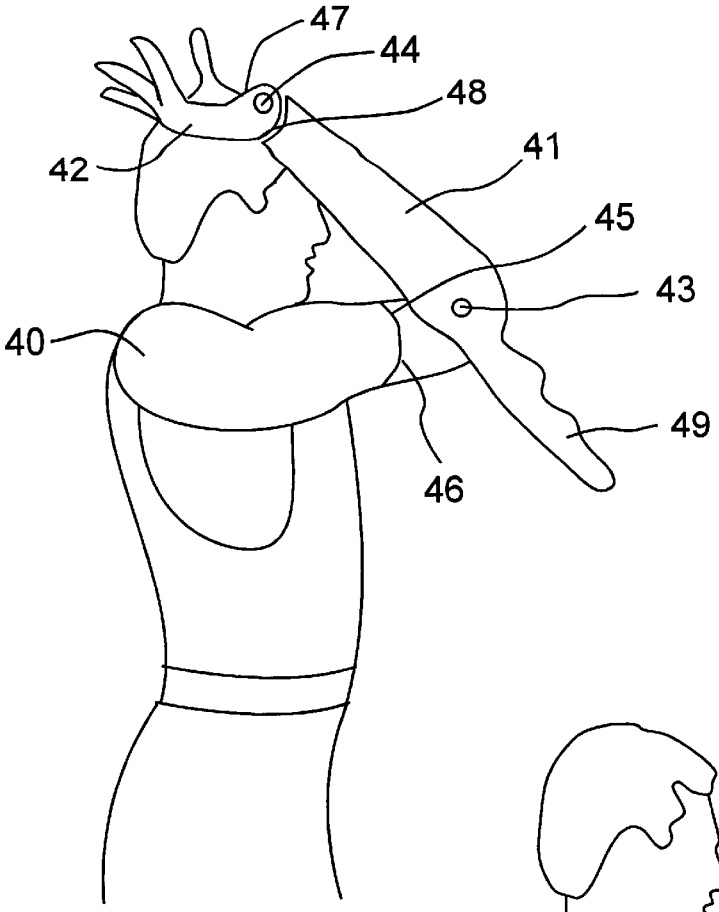
FIG. 13 is a diagram showing a basketball throwing action toy in accordance with an alternative embodiment of the present invention at the start of the throwing action; and, FIG. 14 is a diagram showing the basketball throwing action toy of FIG. 13 at the end of the throwing action.
Figure 14:
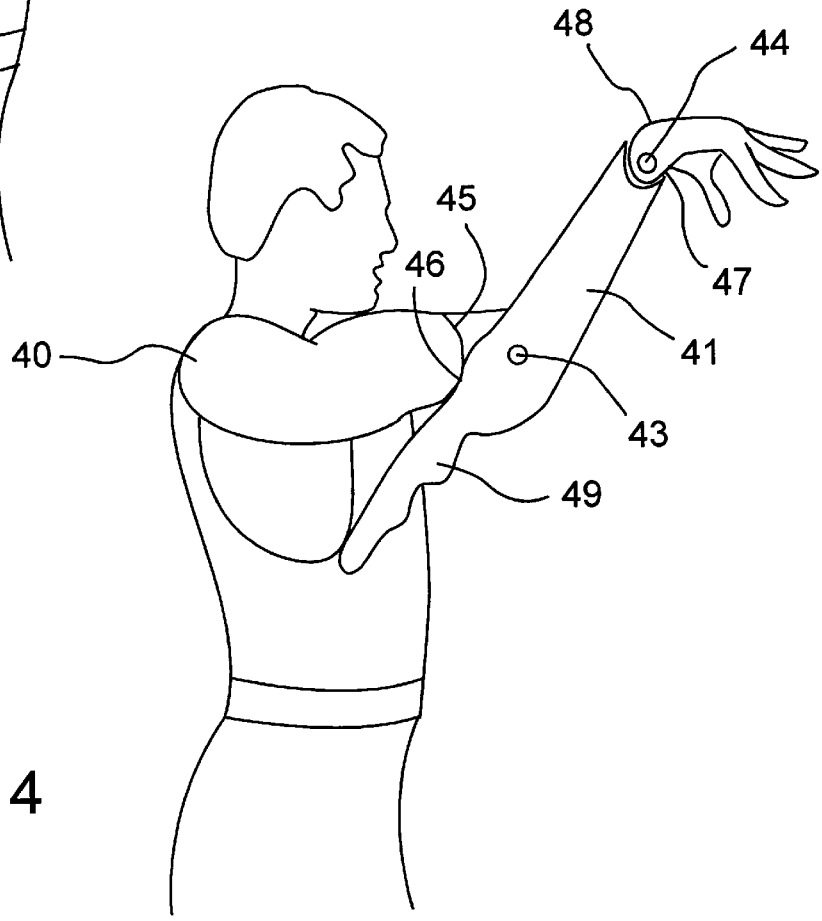

FIGS. 1–12 show variations on the preferred embodiment; FIGS. 13 and 14 relate to an alternative embodiment.

Throughout the drawings, the action toy of the present invention has been shown in diagrammetric form in the interest of clarity. When marketed, products based on the present invention will have a more finished appearance in which the operating mechanism emphasized herein will largely be concealed.

Figure 1:
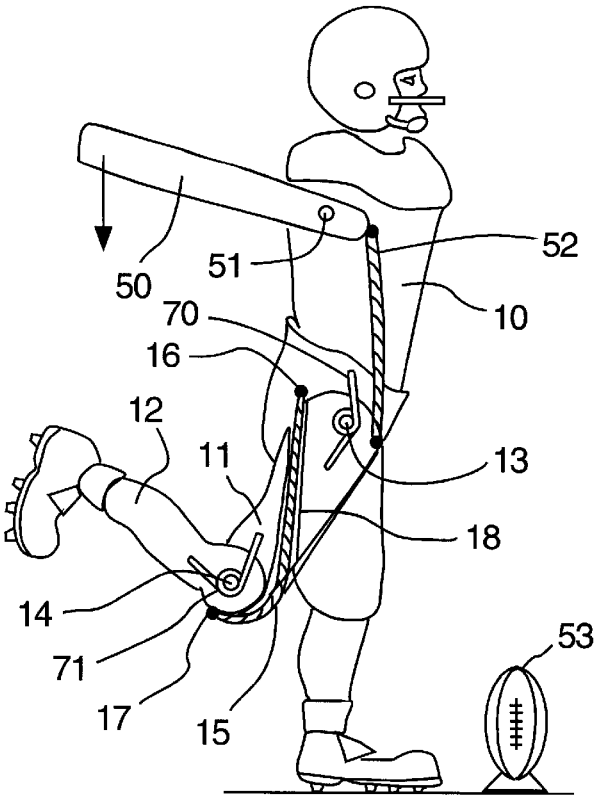
FIG. 1 is a diagram showing a football kicking action toy in accordance with a preferred embodiment of the present invention at the start of the kicking action.
Figure 2:
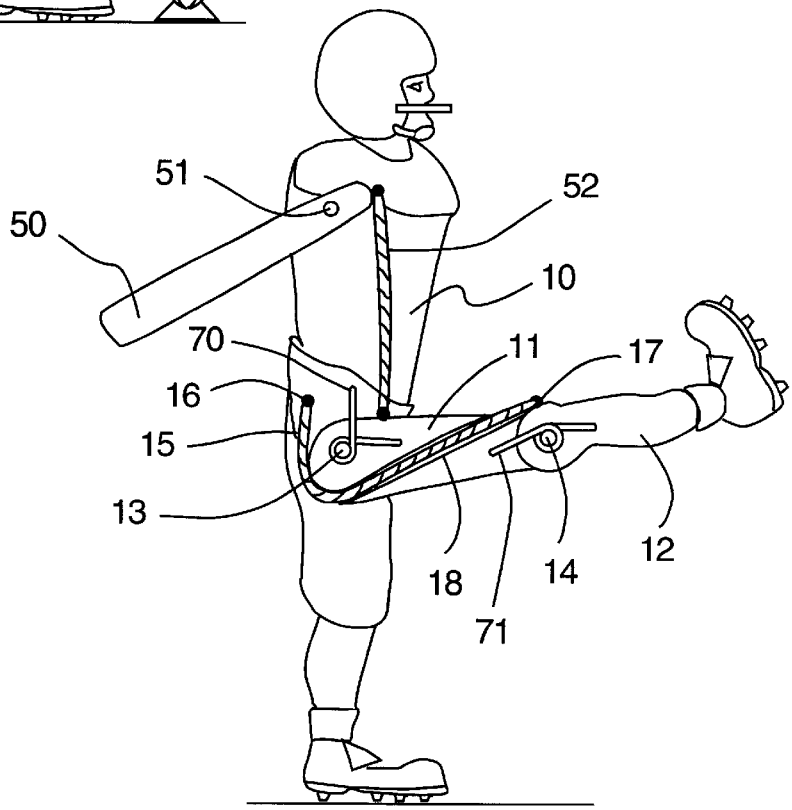
FIG. 2 is a diagram showing the football kicking action toy of FIG. 1 at the end of the kicking action.

FIGS. 1 and 2 show an action toy in accordance with the present invention. The toy is depicted as a football kicker, but in an alternative embodiment is portrayed as a soccer kicker.

A stationary portion 10 of the kicker consists of the kicker's left leg, torso, arms, and head. To this base 10 the right thigh 11 is pivotally connected by a pin 13. The calf and foot of the right leg are a single piece 12 which is pivotally connected to the thigh 11 by the pin 14. A cable 15 extends from a first attachment point 16 spaced from the pin 13 to a second attachment point 17 spaced from the pin 14. To enhance the realism of the toy, a passage 18 is provided through the thigh 11. The cable slides with respect to the passage 18.

The word cable, as used herein, includes without limitation all types of strings, chains, wires, and the like.

To operate the toy of FIGS. 1 and 2, the operator presses sharply downward on the lever 50 that is connected to the torso 10 by a pin 51. This produces an upward pull on the cable 52 that is connected to the front part of the thigh 11. This draws the thigh upwardly, as shown in FIG. 2. The upward motion of the thigh 11 produces a pull on the cable 15 causing the lower part 12 of the leg to extend from its initial position of FIG. 1 to its extended position shown in FIG. 2.

Thereafter, the operator releases the lever 50, and the moving parts may be pushed back to their initial positions or, preferably, the parts may be returned to their initial positions by the use of torsion springs 70 and 71 mounted on respective pins 13 and 14.

Preferably, a circumferential groove is provided around the upper end of the part 12 to provide lateral stabilization for the cable 15.

In playing with the toy, the operator may choose to stand a football 53 in a position where it will be struck by the kicking foot.

Figure 3:
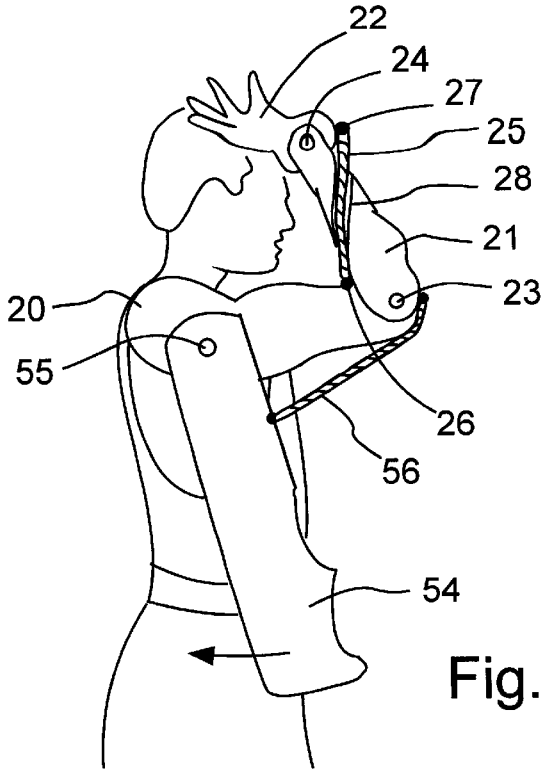
FIG. 3 is a diagram showing a basketball throwing action toy in accordance with a preferred embodiment of the present invention at the start of the throwing action.
Figure 4:
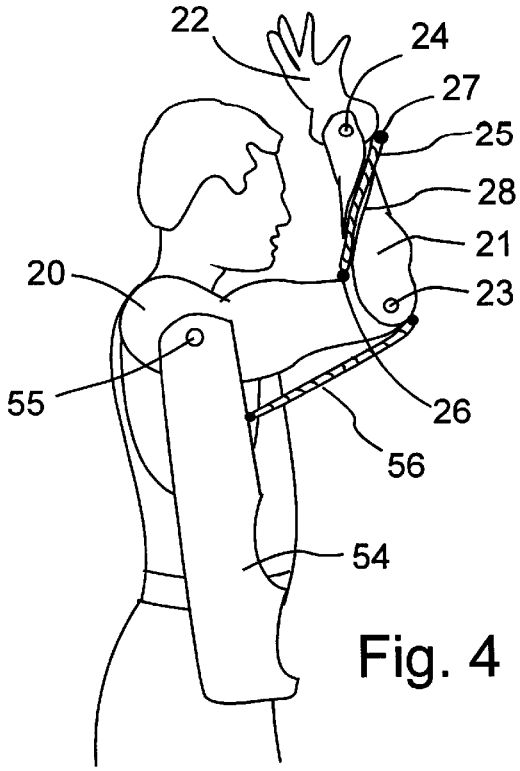
FIG. 4 is a diagram showing the basketball throwing action toy of FIG. 3 at an intermediate stage of the throwing action.
Figure 5:
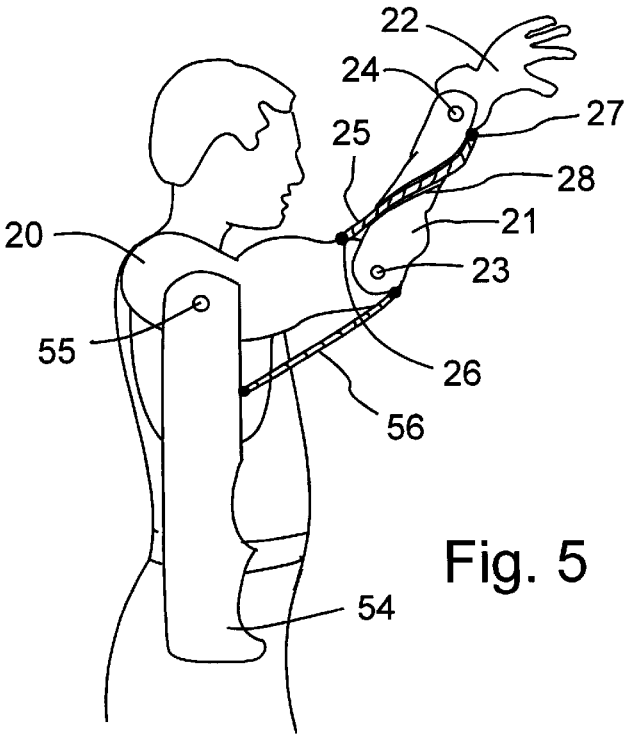
FIG. 5 is a diagram showing the basketball throwing action toy of FIG. 3 at the end of the throwing action.

FIGS. 3–5 show another action toy in accordance with the preferred embodiment in which the action toy throws a toy basketball or baseball. The figures show the action in the initial position, part way through the action, and in the final position respectively. A stationary base portion 20 includes as one piece the torso and upper arm of the basketball player. The right forearm 21 of the player is pivotally connected to the distal end of the upper arm by a pin 23. The other end of the forearm 21 is pivotally connected to a hand 22 by the pin 24. One end of a cable 25 is attached to the upper arm at a first attachment point 26 which is spaced from the pin 23. The other end of the cable is attached to the hand 22 at a second attachment point 27 that is spaced from the pin 24. The forearm 21 includes a passage 28 through which the cable 25 slides as the action progresses. The passage helps to conceal the cable and also serves to guide and direct the cable.

The action toy of FIGS. 3–5 further includes a lever 54 that is pivotally connected to the stationary upper arm 20 by a pin 55. One end of a cable 56 is connected to the lever 54, and the other end of the cable 56 is attached to the forearm 21.

To operate the action toy, the user pulls back on the lever 54 in the direction indicated by the arrow in FIG. 3. This causes the cable 56 to pull on the forearm 21, causing the forearm to rotate clockwise as seen in FIGS. 3–5. As the forearm extends forwardly, the cable 25 is drawn through the passage 28, pulling on the hand 22 at the second attachment point 27. This pulling causes the hand to rotate about the pin 24 relative to the forearm 21. As a result, the motion of the forearm and hand mimic the action of a human athlete in shooting a basket or throwing a baseball. Normally, a toy basketball or a toy baseball would be placed by the user into the hand 22 before the user pulls on the lever 54. A skilled user can control the trajectory of the basketball or baseball through the manner in which he pulls on the lever 54.

It can be seen that if the cable 25 is slack at the initial position of FIG. 3, or is slightly elastic, motion of the hand 22 with respect to the forearm 21 will be delayed until the slack has been taken up (counterclockwise rotation of the hand being prevented by a mechanical stop). Thus, the use of a cable in accordance with the present invention enables the designer to provide intermittent motion as may be required to more closely simulate the motions of a skilled human athlete.

Figure 6:
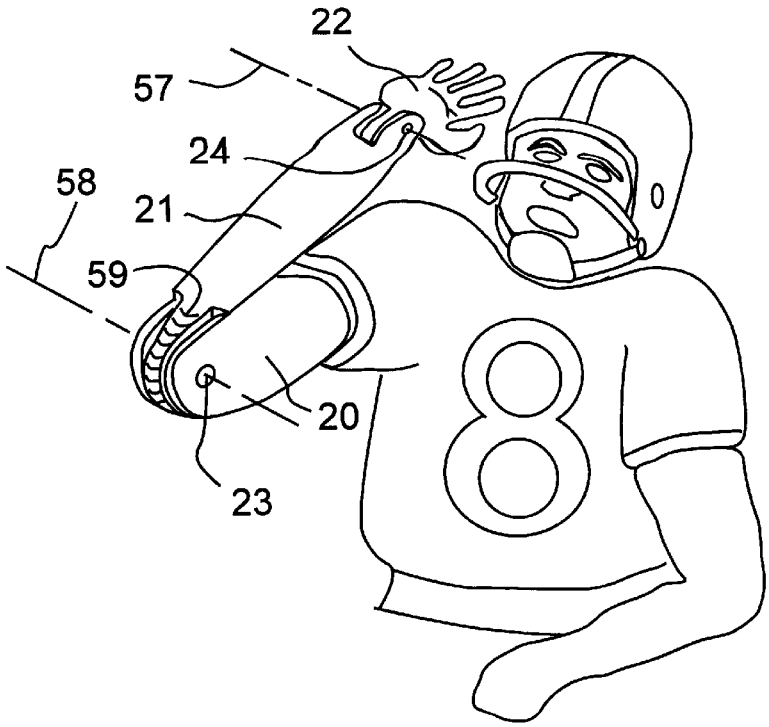
FIG. 6 is a diagram showing a football throwing action toy in accordance with a preferred embodiment of the present invention at the start of the throwing action.
Figure 7:
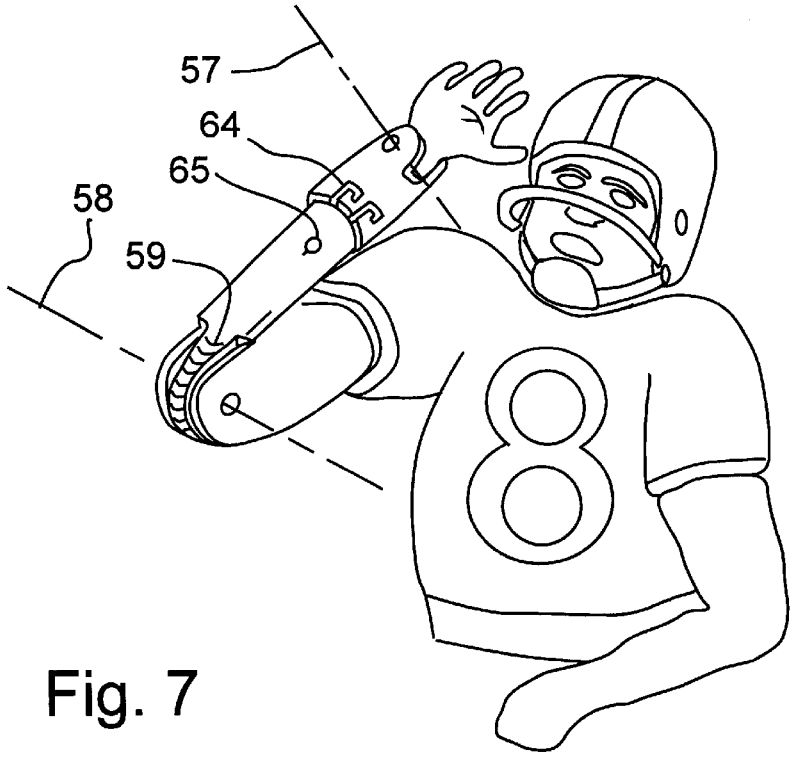
FIG. 7 is a diagram showing a football throwing action toy that is a variation of the football throwing action toy of FIG. 6.

FIGS. 6 and 7 show the mechanism of FIGS. 3–5 portrayed as a football player. In the interest of clarity, some of the parts are not shown in the figures.

In FIG. 6, the axis 57 of the pin 24 is parallel to the axis 58 of the pin 23. In contrast, in FIG. 7, the axis 57 is skewed with respect to the axis 58. A bayonet socket 64 permits the tilt of the axis 57 to be adjusted. This feature gives the user better control when using a football to throw "spirals" and when using a baseball to throw "curves." In both cases, by skewing the axis 57 a spin is imparted to the ball.

FIGS. 6 and 7 show how a groove 59 can be provided in one or more of the moving parts to provide lateral stability to a cable. Also, an eye 65 may be used to change the direction of the cable.

FIGS. 8-14 12 show the principle of the preferred embodiment applied to an action toy that represents a golfer. FIGS.

Figure 8:
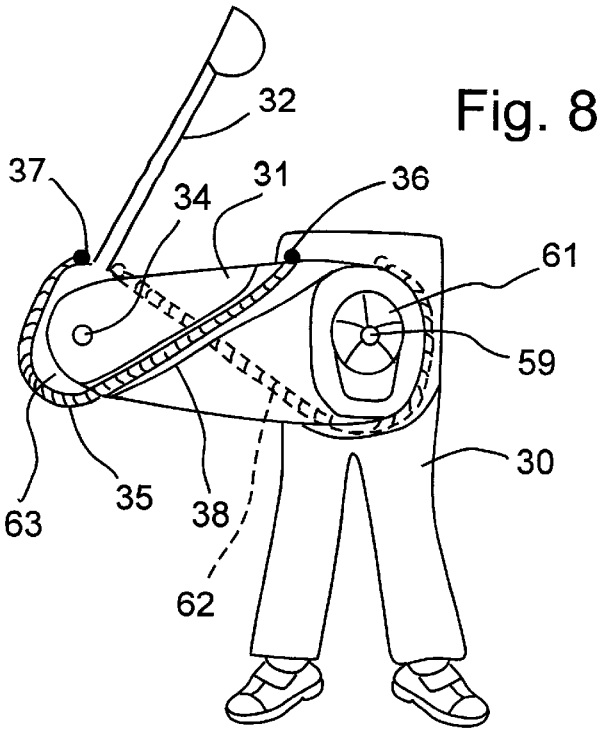
FIG. 8 is a diagram showing a golf club swinging action toy in accordance with a preferred embodiment of the present invention at the start of the swinging action.
Figure 9:
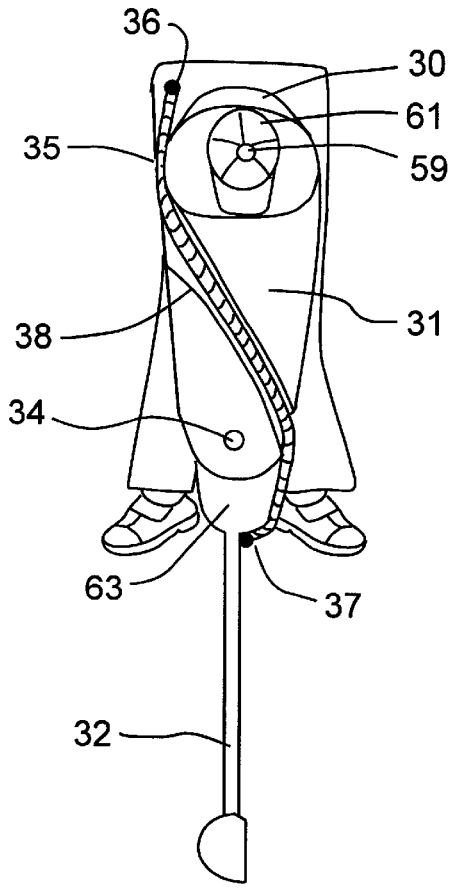
FIG. 9 is a diagram showing the golf club swinging action toy of FIG. 8 at an intermediate stage of the swinging action.
Figure 10:
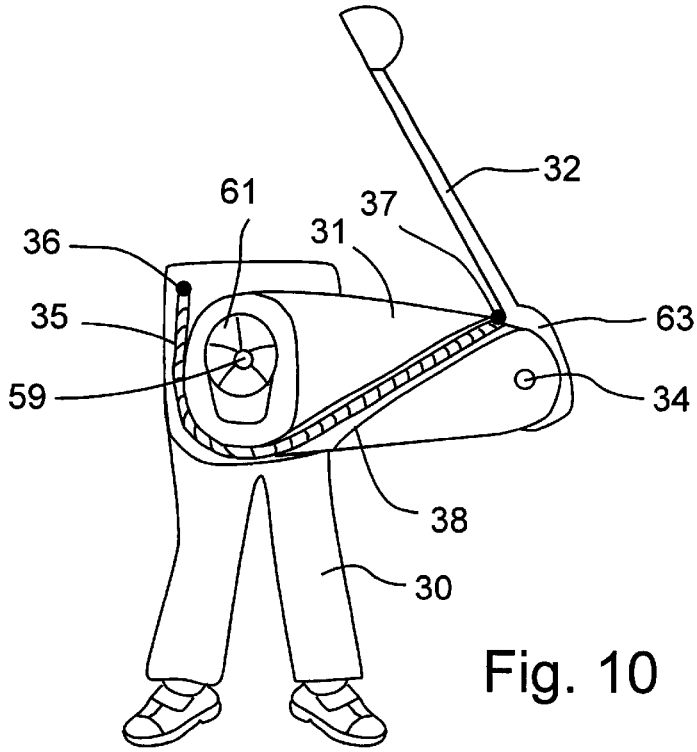
FIG. 10 is a diagram showing the golf club swinging action toy of FIG. 8 at the end of the swinging action.
Figure 12:
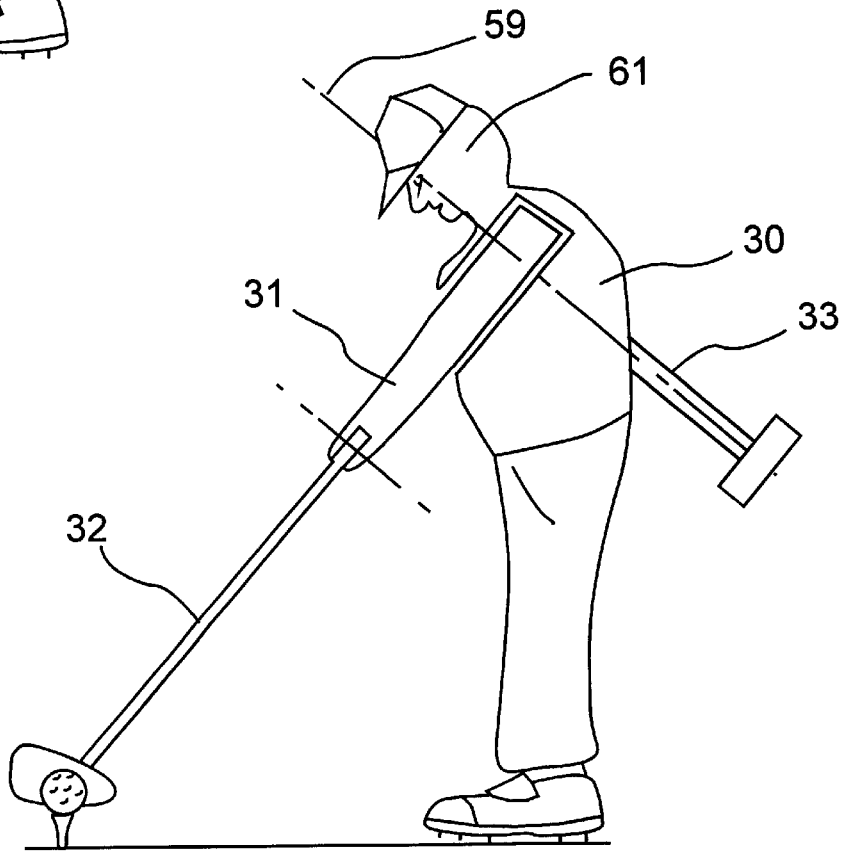
FIG. 12 is a diagram showing the golf club swinging action toy of FIG. 8 in a side elevational aspect at an intermediate stage of the swinging action.

11 and 12 are side elevational views, and FIGS. 8, 9, and 10 are views in the direction of the axis 59 of FIG. 12.

Figure 11:
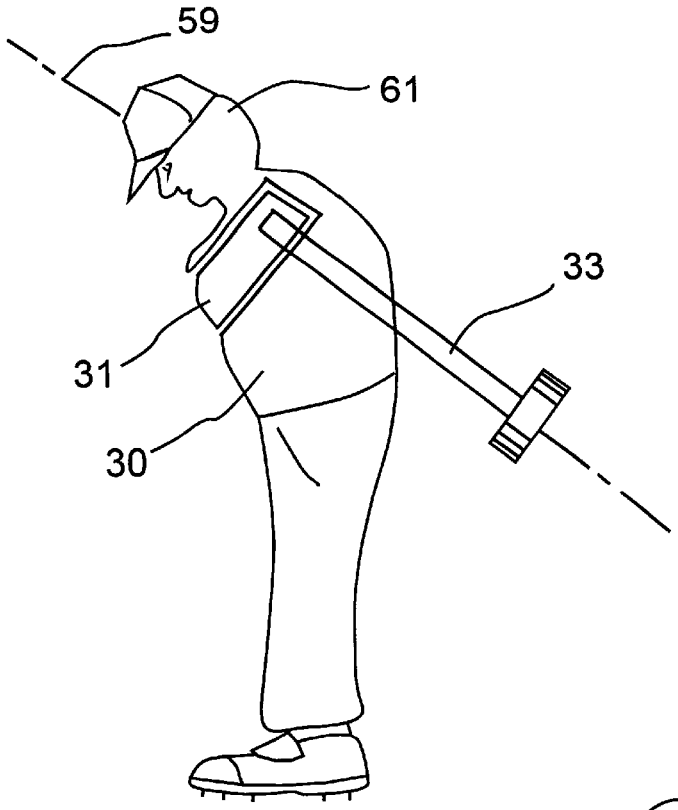
FIG. 11 is a diagram showing the golf club swinging action toy of FIG. 8 in a side elevational aspect at the start of the swinging action.

As best seen in FIG. 11, in this embodiment, a one-piece base 30 includes the legs, the lower portion of the torso, part of the upper torso, the neck, and the head. The arms of the figure are included in a first member 31 that is rotated with respect to the base 30 by turning the shaft 33. The head 61 is held in the position shown by a portion 62 of the base 30.

FIG. 8 shows the action toy in an initial position. FIG. 9 shows the action toy at the mid-point of its swing, and FIG. 10 shows the figure at the end of its swing. A second member 32 represents the hands and the golf club. The first member 31 representing the arms and shoulders of the golfer are connected to the second member 32 by the pin 34. A cable 35 has a first end that is attached to a first attachment point 36 that is located at the upper end of the torso 30 at a position corresponding approximately to the golfer's shoulder. Note that this attachment point remains stationary throughout the swing. The other end of the cable 35 is affixed to a second attachment point 37 located on the second member 32. The first attachment point 36 is spaced from the axis 59, and the second attachment point 37 is spaced from the axis of the pin 34.

The operator turns the shaft 33 to power the rotation of the first member 31 that represents the arms and shoulders of the golfer. This causes the first member 31 to rotate about the axis 59 in a counterclockwise sense as viewed in FIGS. 8–10. Because the first attachment point 36 is spaced from the axis 59, rotation of the first member 31 causes the cable 35 to wind partially around the first member 31, thereby pulling on the second attachment point 37. This pulling causes the second member 32 to rotate counterclockwise as seen in FIGS. 8–10 about the pin 34 relative to the first member 31. The cable 35 slides within a passage 38 in the first member 31.

An optional second cable 62, shown in dashed lines in FIG. 8, may be used for returning the members 31 and 32 to their initial positions. Alternatively, torsion springs may be used.

The golfer of FIGS. 8–12 illustrates a major advantage that the present invention gives to the designer in simulating the motions of a human athlete. The shape of the cam 63 allows a degree of control over the rotational speed and acceleration of the second member 32.

In the example shown in the drawings, the designer has chosen an oval shape having a varying radius measured from the pin 34 to the point at which the cable 35 acts on the cam 63. This helps to produce a rotational speed of the second member 32, with respect to the first member 31, that is relatively slow at the start and at the finish of the swing, but relatively fast as the golf club approaches the golf ball. The result is a realistic simulation of the wrist action used by a skilled human golfer. So far as is known, nothing comparable can be found in the prior art.

FIGS. 13 and 14 show an action toy of an alternative embodiment. This embodiment is similar to the basketball player embodiment of FIGS. 3–5, with the notable exception that the cable 25 of FIGS. 3–5 is omitted. Accordingly, the motion of the hand 42 is not coordinated in the same manner with the motion of the forearm 41. Nevertheless, the relative positions of these parts at the beginning of the action, as shown in FIG. 13 and at the end of the action, as shown in FIG. 14 are the same, and the intermediate positions occur so quickly that the eye cannot observe them.

In the embodiment of FIGS. 13 and 14, a stationary one-piece base 40 includes the torso and upper arm of the basketball player. The forearm 41 is pivotally connected to the upper arm 40 by the pin 43, and the hand 42 is pivotally connected to the forearm 41 by the pin 44. Portions 45 and 46 of the upper arm serve as mechanical stops to limit motion of the forearm, and portions 47 and 48 of the hand serve as mechanical stops to limit motion of the hand with respect to the forearm. A handle 49 extends from the forearm 41.

To operate the action toy of FIGS. 13 and 14, the user places a toy basketball or other projectile in the upturned hand 42 of FIG. 13. Next, the user pulls sharply back on the handle 49, causing the forearm 41 to rotate in the clockwise sense as seen in FIGS. 13 and 14. During most of its motion, the hand remains in the position shown in FIG. 13 with respect to the forearm 41. However, at the end of the rotation of the forearm 41, after the forearm has hit the stop 46, the momentum of the hand 42 carries it to the position shown in FIG. 14.

Thus, there has been described a preferred embodiment of an action toy having parts that are capable of coordinated movement. In the preferred embodiment, the coordination is achieved by a cable. One end of the cable is anchored to a base to which a first member is pivotally connected. A second member is pivotally connected to the first member, and the cable is also connected to the second member after slidingly engaging the first member. As the first member is driven by the operator with respect to the base, the cable is taken up by its sliding engagement with the first member, thereby producing a pull on the second member and forcing the second member to rotate in relation to the rotation of the first member. The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. An action toy having articulated members capable of coordinated movement, comprising:

a base;

a first member connected to said base for motion about a first axis with respect to said base;

a second member connected to said first member for motion about a second axis with respect to said first member; and, a cable having a first end attached to said base at a first attachment point spaced from said first axis and having a second end attached to said second member at a second attachment point spaced from said second axis, said first member having a portion slidably engaging said cable so that relative motion of said first member with respect to said base in a direction away from the first attachment point increases the distance between the first attachment point and the portion of said first member that engages said cable, causing said cable to draw on said second member and causing said second member to rotate about the second axis with respect to said first member.

2. The action toy of claim 1 wherein the first axis is skewed with respect to the second axis.

3. The action toy of claim 2 further comprising means connected to said second member for adjusting the tilt of the second axis.

4. The action toy of claim 1 wherein the first axis is parallel to the second axis.

5. The action toy of claim 1 further comprising means connected to said base and to said first member and biasing said first member toward the first attachment point.

6. The action toy of claim 1 further comprising means connected to said first member and to said second member and biasing said second member away from the portion of said first member that slidably engages said cable.

7. The action toy of claim 1 wherein the portion of said first member that slidably engages said cable is a passage through said first member.

8. The action toy of claim 1 wherein the portion of said first member that slidably engages said cable is a groove.

9. The action toy of claim 1 wherein the portion of said first member that slidably engages said cable is an eye.

10. The action toy of claim 1 wherein said base is adapted to resemble an upper arm, wherein said first member is adapted to resemble a forearm, and wherein said second member is adapted to resemble a hand.

11. The action toy of claim 1 wherein said base is adapted to resemble a lower torso, wherein said first member is adapted to resemble a thigh, and wherein said second member is adapted to resemble a lower portion of a leg.

12. The action toy of claim 1 wherein said base is adapted to resemble a lower torso, wherein said first member is adapted to resemble part of an upper torso with arms extending from it, and wherein said second member is adapted to resemble a pair of hands holding an implement.

13. A humanoid action toy that can be operated to throw a projectile as it executes a throwing action in which the toy progresses from a starting configuration to a final configuration, said humanoid action toy comprising:

a stationary upper arm that extends approximately horizontally and includes a proximal end and a distal end;

a forearm having a proximal end and a distal end;

first hinge means pivotally connecting the distal end of the upper arm to the proximal end of the forearm for pivotal motion of the forearm with respect to the upper arm;

said forearm being flexed in the starting configuration to lie above the upper arm, and rotating during the throwing action to a final extended position;

a hand having a proximal end and having a concave surface;

second hinge means pivotally connecting the distal end of the forearm to the proximal end of the hand for pivotal motion of the hand with respect to the forearm;

said hand located approximately above the proximal end of the upper arm with the concave surface of the hand facing upward in the starting configuration to support and stabilize the projectile, whereby the momentum acquired by the hand in the throwing action causes the hand to rotate, after the forearm has reached its final extended position, to a final position of the hand in which the concave surface of the hand faces downward; and, driving means connected to the forearm for driving the forearm in rotation with respect to the upper arm so as to extend the forearm.

14. The humanoid action toy of claim 13 wherein said driving means further comprise a cable that in the starting configuration is wound partly around the proximal end of the forearm and that is pulled away from the proximal end of the forearm to drive the forearm in rotation.

15. The humanoid action toy of claim 13 wherein said forearm further includes a handle extending from the proximal end of the forearm, whereby a force applied to the handle to operate the toy causes the forearm to rotate about the first hinge means.

* * * * *